US008080933B2

(12) United States Patent
Takeda et al.

(10) Patent No.: US 8,080,933 B2
(45) Date of Patent: Dec. 20, 2011

(54) ELECTRON-EMITTING DEVICE AND IMAGE DISPLAY APPARATUS

(75) Inventors: Toshihiko Takeda, Yokohama (JP); Takeo Tsukamoto, Atsugi (JP); Koki Nukanobu, Machida (JP); Takuto Moriguchi, Chigasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 307 days.

(21) Appl. No.: 12/429,332

(22) Filed: Apr. 24, 2009

(65) Prior Publication Data

US 2009/0284119 A1 Nov. 19, 2009

(30) Foreign Application Priority Data

May 14, 2008 (JP) ..... 2008-126626

(51) Int. Cl.
*H01J 1/62* (2006.01)

(52) U.S. Cl. ..... 313/497; 313/495; 445/25

(58) Field of Classification Search ..... 313/495–497; 445/24–25; 315/169.1
See application file for complete search history.

(56) References Cited

U.S. PATENT DOCUMENTS

| | | | | |
|---|---|---|---|---|
| 4,904,895 | A | 2/1990 | Tsukamoto et al. | |
| 5,066,883 | A | 11/1991 | Yoshioka et al. | |
| 5,532,544 | A | 7/1996 | Yoshioka et al. | |
| 5,605,483 | A | 2/1997 | Takeda et al. | |
| 5,661,362 | A | 8/1997 | Yoshioka et al. | |
| 5,749,763 | A | 5/1998 | Yoshioka et al. | |
| 5,759,080 | A * | 6/1998 | Yoshioka et al. | 445/51 |
| 5,786,658 | A | 7/1998 | Tsukamoto et al. | |
| 5,847,495 | A | 12/1998 | Yamanobe et al. | |
| 5,872,541 | A | 2/1999 | Yoshioka et al. | |
| 5,986,389 | A * | 11/1999 | Tsukamoto | 313/310 |
| 6,147,449 | A | 11/2000 | Iwasaki et al. | |
| 6,171,162 | B1 | 1/2001 | Iwasaki et al. | |
| 6,179,678 | B1 | 1/2001 | Kishi et al. | |
| 6,184,610 | B1 | 2/2001 | Shibata et al. | |
| 6,231,413 | B1 | 5/2001 | Tsukamoto | |
| 6,246,168 | B1 | 6/2001 | Kishi et al. | |
| 6,267,636 | B1 | 7/2001 | Onishi et al. | |
| 6,278,233 | B1 | 8/2001 | Sanou et al. | |
| 6,288,494 | B1 | 9/2001 | Tsukamoto et al. | |
| 6,313,815 | B1 | 11/2001 | Takeda et al. | |
| 6,348,761 | B1 | 2/2002 | Nomura et al. | |
| 6,379,211 | B2 | 4/2002 | Onishi et al. | |
| 6,435,928 | B1 | 8/2002 | Tsukamoto | |
| 6,459,207 | B1 | 10/2002 | Nomura et al. | |
| 6,472,814 | B1 | 10/2002 | Yamanobe et al. | |

(Continued)

FOREIGN PATENT DOCUMENTS

| | | | |
|---|---|---|---|
| CN | 1219750 | A | 6/1999 |

(Continued)

*Primary Examiner* — Nimeshkumar Patel
*Assistant Examiner* — Mary Ellen Bowman
(74) *Attorney, Agent, or Firm* — Fitzpatrick, Cella, Harper & Scinto

(57) ABSTRACT

The present invention provides an electron-emitting device which does not need a fresh electrode to be added thereto, has excellent convergence and shows little change of a discharged electric current for short and long periods of time, and an image display apparatus using the device. The electron-emitting device includes at least a pair of device electrodes formed on an insulating substrate, and a plurality of electroconductive films which are formed so as to connect the device electrodes to each other and have gaps therein, wherein the surface of a region which is at least adjacent to the gap between the electroconductive films and is not covered with the electroconductive film is higher than the surface of the electroconductive film.

12 Claims, 11 Drawing Sheets

U.S. PATENT DOCUMENTS 6,473,063 B1 10/2002 Suzuki et al.
6,515,640 B2 2/2003 Tsukamoto et al.
6,555,957 B1 4/2003 Nomura et al.
6,608,437 B1 8/2003 Kishi et al.
6,626,719 B2 9/2003 Ono et al.
6,726,520 B2 4/2004 Takeda et al.
6,760,002 B2 7/2004 Suzuki et al.
6,835,110 B2 12/2004 Mizuno et al.
6,843,696 B2 1/2005 Kitamura et al.
6,848,962 B2 2/2005 Kitamura et al.
6,858,990 B2 2/2005 Tsukamoto
6,896,571 B2 5/2005 Mizuno et al.
6,900,581 B2 5/2005 Kyogaku et al.
6,948,995 B2 9/2005 Ishikura et al.
7,012,362 B2 3/2006 Kawate et al.
7,021,981 B2 4/2006 Onishi et al.
7,034,444 B2 4/2006 Tsukamoto
7,057,336 B2 6/2006 Kishi et al.
7,064,475 B2 6/2006 Kuroda et al.
7,067,336 B1 6/2006 Kyogaku et al.
7,074,105 B2 7/2006 Kawate et al.
7,074,380 B2 7/2006 Iwaki et al.
7,077,716 B2 7/2006 Mizuno et al.
7,094,123 B2 8/2006 Oyama et al.
7,131,886 B2 11/2006 Kitamura et al.
7,147,533 B2 12/2006 Kawate et al.
7,186,160 B2 3/2007 Tsukamoto
7,189,427 B2 3/2007 Takeda et al.
7,198,966 B2 4/2007 Kitamura et al.
RE39,633 E 5/2007 Yoshioka et al.
7,227,311 B2 6/2007 Tsukamoto
7,234,985 B2 6/2007 Kishi et al.
7,258,590 B2 8/2007 Oyama et al.
7,271,529 B2 * 9/2007 Takeda et al. ..... 313/311
7,298,079 B2 11/2007 Danjo et al.
7,312,561 B2 12/2007 Moriguchi et al.
RE40,062 E 2/2008 Yoshioka et al.
7,399,215 B2 7/2008 Tsukamoto
7,419,416 B2 9/2008 Tsukamoto
7,432,883 B2 10/2008 Oyama et al.
7,442,404 B2 10/2008 Kuroda et al.
RE40,566 E 11/2008 Yoshioka et al.
7,459,844 B2 12/2008 Tsukamoto
7,528,538 B2 5/2009 Kitamura et al.
7,572,164 B2 8/2009 Takeda et al.
7,582,001 B2 9/2009 Kitamura et al.
7,583,015 B2 9/2009 Nukanobu et al.
2005/0287689 A1 12/2005 Iwaki et al.
2006/0228478 A1 10/2006 Iwaki et al.
2007/0018561 A1 * 1/2007 Nukanobu et al. ..... 313/495
2007/0141943 A1 6/2007 Kawate et al.
2007/0188067 A1 8/2007 Tsukamoto et al.
2008/0045112 A1 2/2008 Kishi et al.
2008/0106181 A1 5/2008 Kawate et al.
2008/0122336 A1 5/2008 Nukanobu et al.
2009/0180946 A1 7/2009 Kitamura et al.
2009/0237570 A1 9/2009 Moriguchi et al.
2009/0244398 A1 10/2009 Nukanobu et al.
2009/0256457 A1 10/2009 Tsukamoto et al.
2009/0256464 A1 10/2009 Tsukamoto et al.
2009/0273274 A1 11/2009 Takeda et al.
2009/0284120 A1 11/2009 Nukanobu et al.
2009/0284123 A1 * 11/2009 Nishida et al. ..... 313/311
2009/0284127 A1 11/2009 Takeuchi et al.

FOREIGN PATENT DOCUMENTS

JP 2002-352699 A 12/2002

* cited by examiner

ELECTRON-EMITTING DEVICE AND IMAGE DISPLAY APPARATUS

BACKGROUND OF THE INVENTION

1. Field of the Invention

The present invention relates to an electron-emitting device, and an image display apparatus provided with a plurality of the devices.

2. Description of the Related Art

A surface-conduction type of an electron-emitting device uses a phenomenon that an electron is emitted when an electric current is passed through an electroconductive film formed on an insulating substrate in parallel to the film plane.

Japanese Patent Application Laid-Open No. 2002-352699 discloses the surface-conduction type of the electron-emitting device having a structure of inhibiting an abnormally large current from flowing when an electric discharge has occurred, by dividing the electroconductive film into a plurality of electroconductive films and thereby increasing an electric resistance of each of the electroconductive films.

However, a recent image display apparatus is required to show a performance of stably displaying an image with higher definition for a long period of time. For this reason, in a display to which the electron-emitting device is applied, the electron-emitting device is desired to show high convergence and excellent stability for a long period of time. In an image display apparatus in which a display pixel corresponds to an electron-emitting device in a one-to-one relationship, the fluctuation of an electric current in each of the electron-emitting devices causes variations of brightness among pixels, so that the electron-emitting device needs to be more uniform and stable.

SUMMARY OF THE INVENTION

The present invention is directed at providing an electron-emitting device which does not need a fresh electrode to be added thereto, has excellent convergence and shows little change of a discharged electric current for short and long periods of time, and an image display apparatus using the device.

The present invention provides an electron-emitting device having at least a pair of device electrodes formed on an insulating substrate, and a plurality of electroconductive films which are formed so as to connect the device electrodes to each other and have gaps therein, wherein the surface of a region which is at least adjacent to the gap between the electroconductive films and is not covered with the electroconductive film is higher than the surface of the electroconductive film.

The present invention also provides an electron-emitting device having an insulating substrate, a pair of electrodes arranged on the insulating substrate and a plurality of electroconductive films which are placed in between the pair of the electrodes in parallel so as to connect the electrodes to each other, wherein each of the plurality of the electroconductive films has an electron-emitting portion, and an insulating member which is positioned higher than the surface of the electroconductive film is arranged in a region on the insulating substrate between the electroconductive films adjacent to each other among the plurality of the electroconductive films.

The present invention also provides an electron-emitting device having an insulating substrate, a pair of electrodes arranged on the insulating substrate and a plurality of electroconductive films which are placed in between the pair of the electrodes in parallel so as to connect the electrodes to each other, wherein each of the plurality of the electroconductive films has an electron-emitting portion, and the surface of the insulating substrate in between the electroconductive films adjacent to each other among the plurality of the electroconductive films is positioned higher than the surface of the electroconductive film.

The present invention also provides an image display apparatus comprising a first substrate having a plurality of the electron-emitting devices arranged thereon, and a second substrate which has an image display member to be irradiated with an electron emitted from the electron-emitting device arranged so as to oppose to the electron-emitting devices, and is arranged so as to oppose to the first substrate.

Further features of the present invention will become apparent from the following description of exemplary embodiments with reference to the attached drawings.

DESCRIPTION OF THE EMBODIMENTS

Figure 1A:
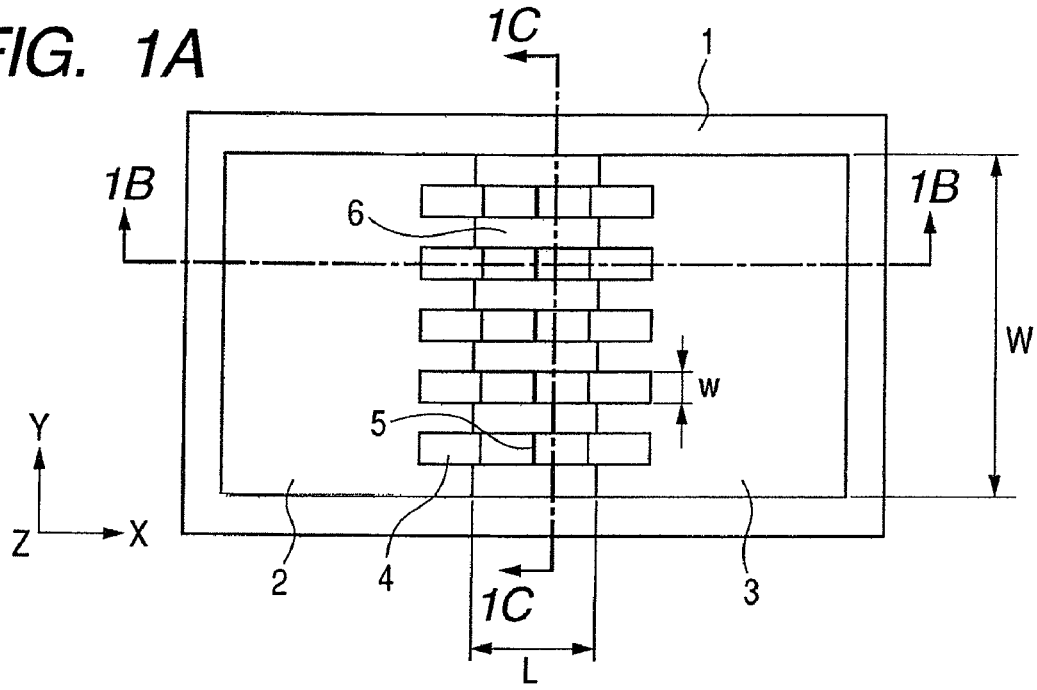
FIGS. 1A, 1B, 1C and 1D are schematic views of one embodiment of an electron-emitting device according to the present invention.

A first aspect of the present invention is an electron-emitting device having at least a pair of device electrodes formed on an insulating substrate, and a plurality of electroconductive films which are formed so as to connect the device electrodes to each other and have gaps in regions between the device electrodes respectively, wherein the surface of a region which is at least adjacent to the gap between the electroconductive films and is not covered with the electroconductive film is higher than the surface of the electroconductive film.

A second aspect of the present invention is an electron-emitting device having an insulating substrate, a pair of electrodes arranged on the insulating substrate and a plurality of electroconductive films which are placed in between the pair of the electrodes in parallel so as to connect the electrodes to each other, wherein each of the plurality of the electroconductive films has an electron-emitting portion, and an insulating member which is positioned higher than the surface of the electroconductive film is arranged in a region on the insulating substrate between the electroconductive films adjacent to each other among the plurality of the electroconductive films.

A third aspect of the present invention is an electron-emitting device having an insulating substrate, a pair of electrodes arranged on the insulating substrate and a plurality of electroconductive films which are placed in between the pair of the electrodes in parallel so as to connect the electrodes to each other, wherein each of the plurality of the electroconductive films has an electron-emitting portion, and the surface of the insulating substrate in between the electroconductive films adjacent to each other among the plurality of the electroconductive films is positioned higher than the surface of the electroconductive film.

The above described electron-emitting device of the present invention can include the following structure as an embodiment. A convex shielding portion is formed in a region which is adjacent to the gap between the electroconductive films and is not covered with the electroconductive film. The above described shielding portion is made from an insulating material. The above described insulating material is any one of aluminum oxide, silicon nitride, magnesium oxide and aluminum nitride. The above described electroconductive films are arranged on the bottom face of a plurality of recess portions formed in between device electrodes on the insulating substrate respectively. The above described bottom face of the recess portion is made from silicon oxide or an insulating material which includes silicon oxide as a main component. The side face of the above described recess portion is made from any one of aluminum oxide, silicon nitride, magnesium oxide and aluminum nitride.

A fourth aspect of the present invention provides an image display apparatus including a first substrate having a plurality of the electron-emitting devices arranged thereon, and a second substrate which has an image display member to be irradiated with an electron emitted from the electron-emitting device arranged so as to oppose to the electron-emitting devices, and is arranged so as to oppose to the first substrate.

The electron-emitting device according to the present invention has the electroconductive film divided into a plurality of the electroconductive films, and accordingly makes a resistance component to be connected to each of the electron-emitting portions increased to inhibit the discharged electric current from fluctuating with time. The electron-emitting device also has a shielding portion or the side face of a recess portion arranged in the vicinity of each electron-emitting portion, thereby cuts off electrons which cause the spread of the beam, and can refine the electron beam. Therefore, the image display apparatus according to the present invention can stably display an image of high quality for a long period of time.

The electron-emitting device according to the present invention includes an electric-field emission type device, an MIM type device and a surface-conduction type electron-emitting device, and is particularly effective in a device having a distribution in an ejection direction of electrons to be emitted, such as a horizontal electric-field emission type device and a surface-conduction type electron-emitting device.

Embodiments of an electron-emitting device according to the present invention will now be described while taking a surface-conduction type electron-emitting device as an example, with reference to the drawings.

The electron-emitting device according to the present invention has such structural features that an electroconductive film is divided into a plurality of the electroconductive films, and the surface of a region which is adjacent to the gap formed in the electroconductive films and is not covered with the electroconductive film is higher than the surface of the electroconductive film. The latter description specifically includes an embodiment 1 having a convex shielding portion formed in a region which is not covered with such an electroconductive film, and an embodiment 2 of previously forming a recess portion in a region in which an electroconductive film is formed.

Figure 1B:
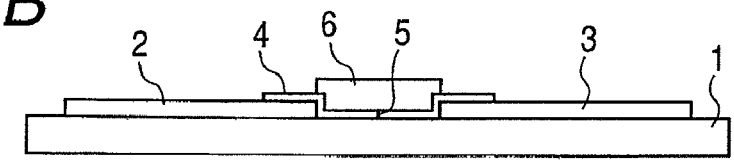
Figure 1C:
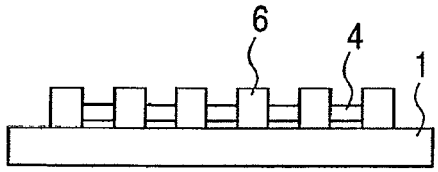
Figure 1D:
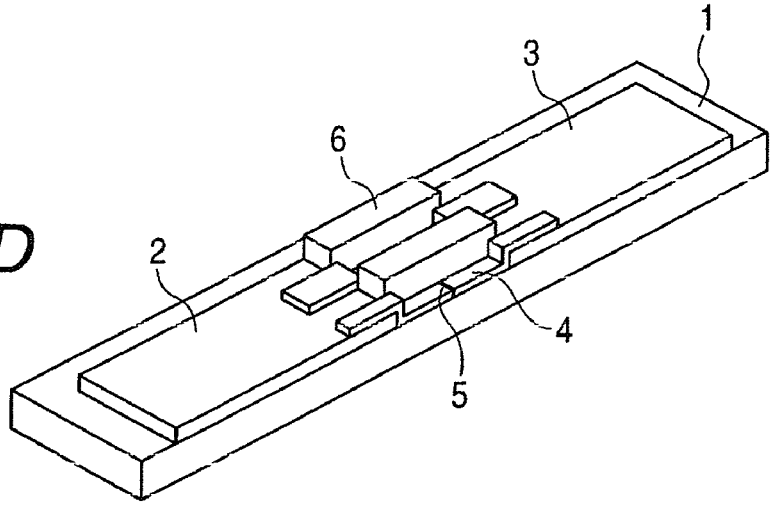
Figure 2A:
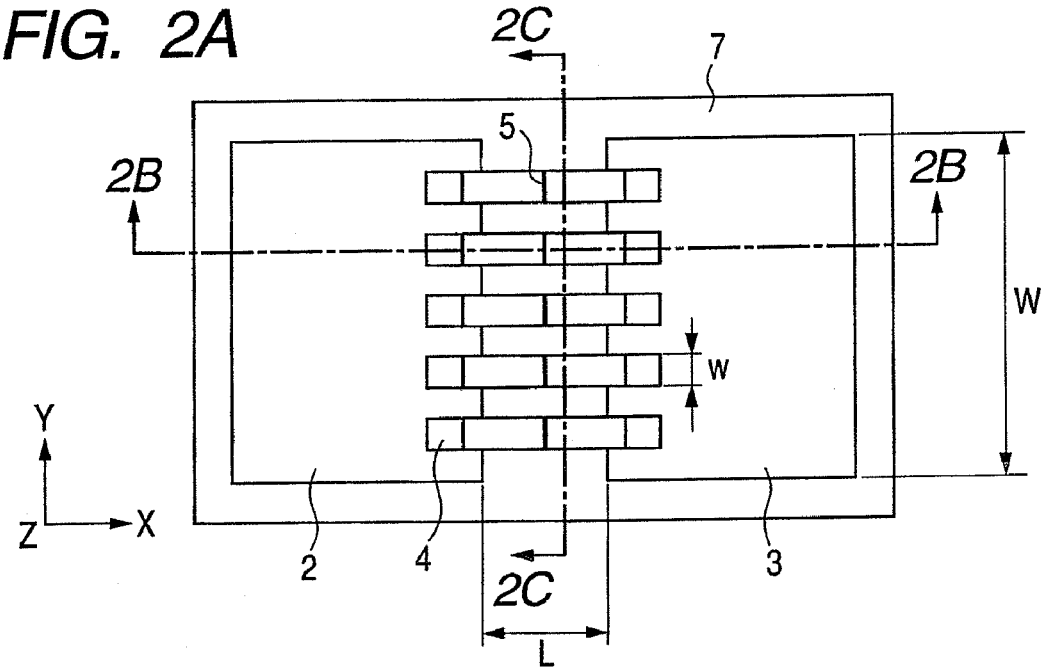
FIGS. 2A, 2B, 2C and 2D are schematic views of another embodiment of an electron-emitting device according to the present invention.
Figure 2B:
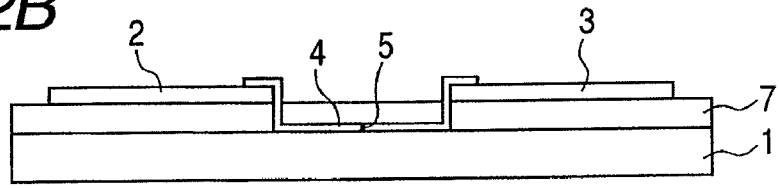
Figure 2C:
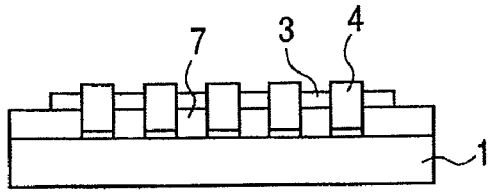
Figure 2D:
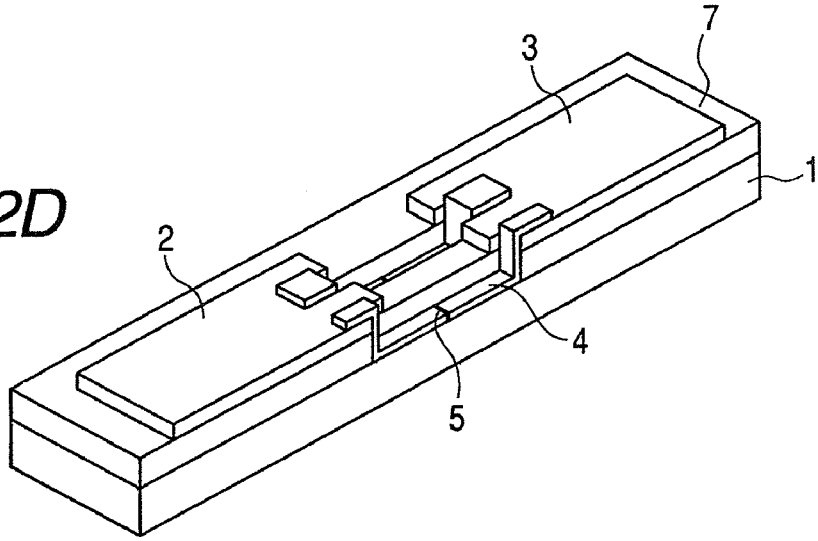

A basic structure example of an electron-emitting device according to the present invention will now be described with reference to FIGS. 1A, 1B, 1C and 1D and FIGS. 2A, 2B, 2C and 2D. FIGS. 1A, 1B, 1C and 1D illustrate a structure example of a device in the above described embodiment 1, and FIGS. 2A, 2B, 2C and 2D illustrate a structure example of a device in the above described embodiment 2. In each figure, FIG. 1A is a schematic plan view, FIG. 1B is a schematic sectional view taken along the line 1B-1B in FIG. 1A, FIG. 1C is a schematic sectional view taken along the line 1C-1C in FIG. 1A, and FIG. 1D is a perspective view in the case where such a device is cut along the line 1C-1C in FIG. 1A.

A basic structure of this device includes a pair of device electrodes 2 and 3 which are formed on an insulating substrate 1 made from glass or the like and oppose to each other, and electroconductive films 4 which are electrically connected to each of the device electrodes 2 and 3. The plurality of the electroconductive film 4 are arranged in parallel in between the pair of the device electrodes 2 and 3, and are connected to each of the device electrodes 2 and 3, but are arranged so as to have a space so that the respective electroconductive films do not directly come in contact with each other. Each of the electroconductive film 4 has a fine gap 5 formed therein, and has an electron-emitting portion in the gap 5.

In a device of FIGS. 1A, 1B, 1C and 1D, a convex shielding portion 6 is arranged in a region which is adjacent to the gap 5 of the electroconductive films 4 arranged in a form of being divided into the plurality of the electroconductive films in between the device electrodes 2 and 3, and is not covered with the electroconductive films 4, in other words, on the surface of the insulating substrate 1. This shielding portion 6 is formed so as to be thicker than the electroconductive film 4, and is configured so that the upper face thereof is positioned higher than the electroconductive film 4, in other words, the gap 5.

In a device of FIGS. 2A, 2B, 2C and 2D, the electroconductive films 4 divided into the plurality of the electroconductive films in between the device electrodes 2 and 3 are arranged respectively on the bottom faces of the plurality of the recess portions formed on the substrate between the device electrodes, respectively. Incidentally, the device employs a substrate which has a substrate coat layer 7 provided on the surface of the insulating substrate 1, prepares the recess portion by partially digging the substrate coat layer 7 to make the surface of the insulating substrate 1 exposed, and has the electroconductive film 4 formed on the surface of the insulating substrate 1. Accordingly, the device is configured so that the side face of the recess portion is arranged adjacent to the gap 5 provided in the electroconductive film 4, and a region which is adjacent to the gap 5 and is not covered with the electroconductive film 4, in other words, the surface of the substrate coat layer 7 is positioned higher than the surface of the electroconductive film 4.

The insulating substrate 1 becomes a substrate for use in forming the electrodes 2 and 3, the electroconductive film 4 and the like thereon, accordingly can be made from an electrically insulative material such as glass, and can be made from the glass when considering the application to an image display apparatus or the like. In addition, as will be described later, a surface-conduction type electron-emitting device to which the present invention is applied passes through an energization step referred to as an activation step in a process of forming an electron-emitting portion, so that a glass containing silicon oxide much can be used as a suitable material for the activation step.

The pair of the device electrodes 2 and 3 which oppose to each other can employ any material as long as the material has electroconductivity, but can employ a material having a lower ohmic value. Particularly, when assuming the case in which the device is applied to an image display apparatus or the like, the device electrode can be made from a material having such high heat resistance as to endure the heating step. Specifically, the material includes Ni, Pt, Au, W, Mo and Al.

An electroconductive material such as a metal and a semiconductor can be used as a material for the electroconductive film 4. As an example, the material includes a metal such as Ni, Cr, Au, Mo, W, Pt, Ti, Al, Cu and Pd, an alloy thereof, a metal such as Pd, Ag, Au, Ru and Pd—Ag, and an oxide thereof.

The shielding portion 6 can employ a metal, or a compound such as a metal oxide and a metal nitride, regardless of whether the material has electroconductivity or insulation properties. However, when being formed from an electroconductive material, the shielding portion 6 needs to be electrically insulated from at least one of the device electrodes 2 and 3. The shielding portion 6 can employ any one of insulating materials of aluminum oxide, silicon nitride, magnesium oxide and aluminum nitride, which will be described later.

In a device of FIGS. 2A, 2B, 2C and 2D, the substrate coat layer 7 is formed on the insulating substrate 1, but the substrate coat layer 7 can be formed from any one of insulating materials of aluminum oxide, silicon nitride, magnesium oxide and aluminum nitride, which will be described later. In addition, it is possible to form the insulating substrate 1 with a glass containing silicon oxide much in order to facilitate carbon to deposit on the gap 5 in the activation step, and to form the recess portion in which the electroconductive film 4 is placed, into such a depth as to make the surface of the insulating substrate 1 exposed.

Next, a function given by a structure of making the surface in a region adjacent to a gap 5 higher than an electroconductive film 4 will now be described with reference to FIG. 3.

Figure 3:
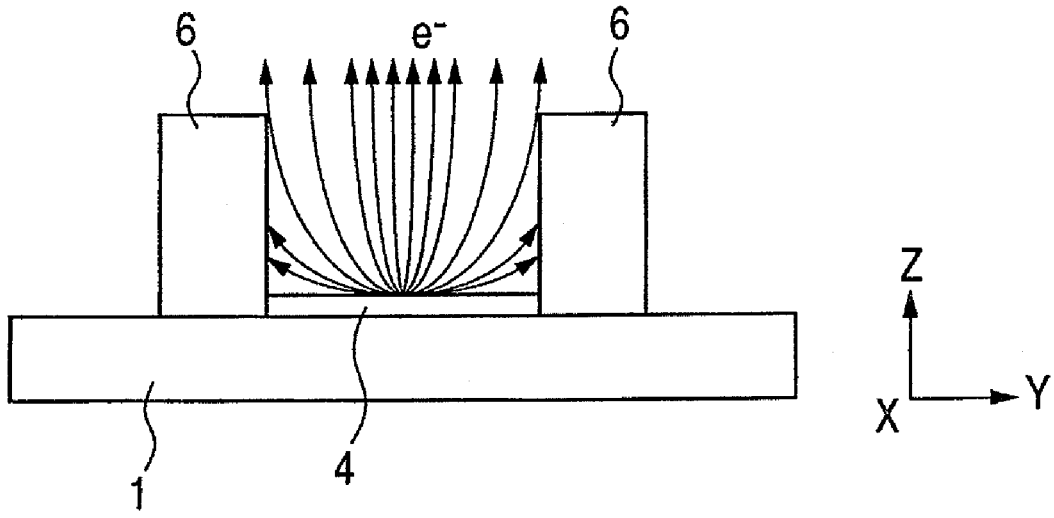
FIG. 3 is a partial schematic view for describing a function of a shielding portion according to the present invention.

FIG. 3 is a partial schematic sectional view in a Y-direction of the device illustrated in FIGS. 1A, 1B, 1C and 1D, and schematically illustrates a trajectory of an electron to be emitted from the gap 5 in one piece of the electroconductive film 4 having a shielding portion 6 arranged on its both sides.

The device causes an electron emission from the fine gap 5 formed in the electroconductive film 4 by applying voltage to the electroconductive film 4. The initial velocity of the emitted electron is determined almost by the voltage applied from the outside, and the device emits the electron to a vacuum almost without causing energy loss. A large number of electron-emitting portions which emit an electron exist in the gap 5, and the large numbers of the electron-emitting portions are arrayed in parallel in one piece of the electroconductive film 4. The great majority of electrons to be emitted from the electron-emitting portions are emitted in a direction in which voltage is applied between the device electrodes 2 and 3, in other words, in a direction (X-direction) parallel to an energization direction, but it is confirmed that some electrons having a component in a direction (Y-direction) perpendicular to the energization direction are also emitted as well. These electrons are accelerated by an electric field in the vicinity of the emitting portion and escape therefrom, which results in causing the spread of the electron beam.

On the other hand, when the shielding portion 6 is arranged in the vicinity of the gap 5, an electron having the initial velocity in a direction perpendicular to an energization direction among the electrons emitted from the electron-emitting portion, in other words, an electron having the initial velocity in the Y-direction collides against the shielding portion 6, and accordingly cannot escape toward the upper side (Z-direction). Thereby, an electron having a velocity segment which causes the spread of electrons in the Y-direction is cut off, and only electrons which have a uniform direction of the initial velocity can be consequently taken out.

As was described above, the direction of the electron to be emitted is not only parallel and perpendicular to the energization direction, but also includes directions having various components. However, electrons emitted in the perpendicular direction generally move at a constant speed, so that electrons that cause the spread can be removed by arranging a wall structure which shields the flight of the electron, such as the shielding portion 6, in the vicinity of the electron-emitting portion.

In addition, as was described above, the electron having the Y-direction component moves at the constant speed, so that as a distance between the shielding portion 6 and the electron-emitting portion becomes farther, a position of the electron in a Z-direction shown when the electron has arrived at a position of the shielding portion 6, in other words, the height of the electron from the electron-emitting portion becomes higher. Thus, the height of the shielding portion 6 necessary for cut off is specified by the distance between the electron-emitting portion and the shielding portion 6.

Figure 4:
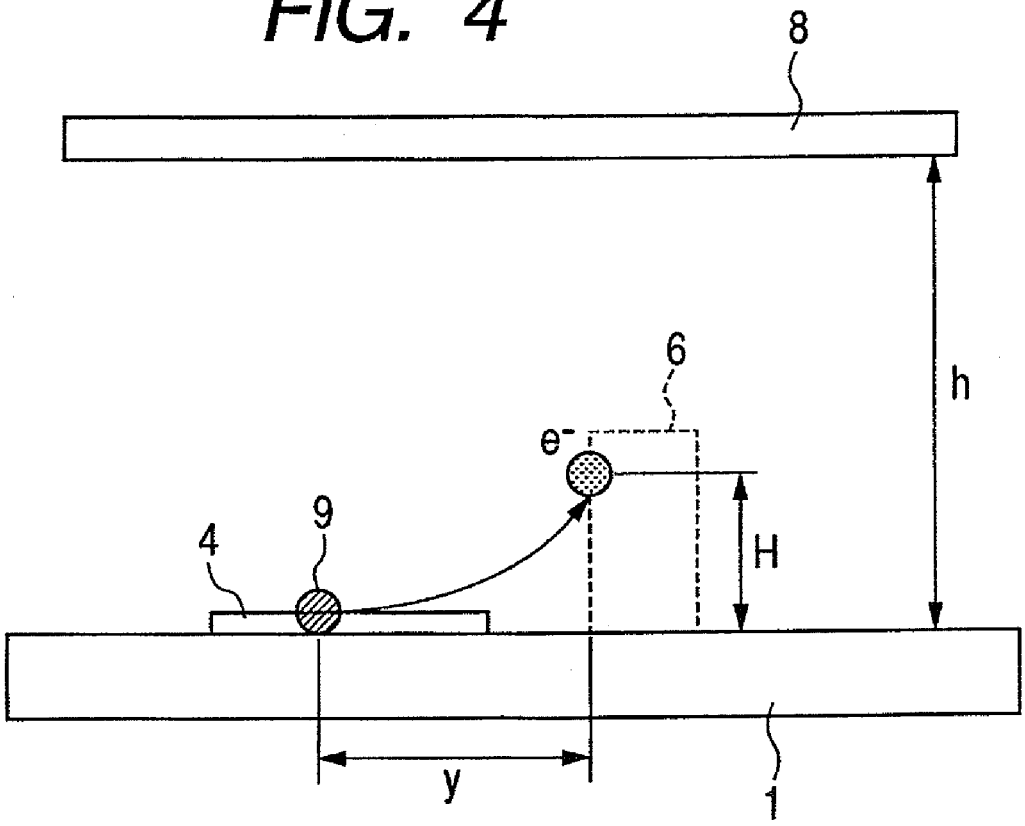
FIG. 4 is a partial schematic view illustrating a relationship between a height of a shielding portion and a spread of an electron beam according to the present invention.

It was found that a distance (y) in the Y-direction between the electron and the electron-emitting portion 9 and a height (H) of the electron from the surface of a substrate 1 at the time, which are illustrated in FIG. 4, are expressed by the relational expression:

$$Y=2H\sqrt{(Vf-\phi)/\{Va/(h\times H)\}},$$

wherein

Vf: driving voltage of device h: distance to anode 8 from surface of substrate 1

ϕ: work function of surface of electron-emitting portion, and

Va: voltage to be applied to anode 8.

Accordingly, when the shielding portion 6 is arranged at the position of 0.01 mm distant from the electron-emitting portion on conditions satisfying Vf=20 V, Φ=5 e V, h=2 mm and Va=10 kV, the height (H) of the electron from the surface of the substrate at the position becomes approximately 0.01 mm. Therefore, the height (H) of the shielding portion 6 necessary for inhibiting the spread of the electron beam becomes 0.01 mm or more.

On the other hand, as is understood from the above expression, the height (H) of the shielding portion 6 necessary for cutting off the electron beam which spreads to the Y-direction becomes lower, as the distance (y) becomes smaller. Accordingly, a unit is effective in which the electroconductive film 4 to be formed within one device is arranged in a form of being divided into a plurality of the electroconductive films, and the shielding portion 6 is arranged so as to sandwich the respective electroconductive films 4.

Such an action similarly works in the device in FIGS. 2A, 2B, 2C and 2D as well, and the side face of the recess portion (substrate coat layer 7 in FIGS. 2A, 2B, 2C and 2D) shows a function corresponding to the shielding portion 6 illustrated in FIGS. 1A, 1B, 1C and 1D.

Next, an activation treatment according to the present invention will now be described in detail.

The activation treatment means a step of introducing a carbon-containing gas into a vacuum apparatus, applying voltage between device electrodes 2 and 3 under an atmosphere containing the carbon-containing gas, and making a film containing carbon (carbon film) deposited on an electroconductive film 4 and a gap 5 from the carbon-containing gas existing in the atmosphere.

A gas of an organic substance can be used as the above described carbon-containing gas. The organic substance can include: aliphatic hydrocarbons of an alkane, an alkene and an alkine; aromatic hydrocarbons; alcohols; aldehydes; ketones; amines; and organic acids such as phenol, a carboxylic acid and a sulfonic acid. Specifically, the organic substance can include a saturated hydrocarbon expressed by $C_nH_{2n+2}$ such as methane, ethane and propane, and an unsaturated hydrocarbon expressed by a composition formula of $C_nH_{2n}$ and the like, such as ethylene and propylene. The usable organic substance includes benzene, toluene, methanol, ethanol, formaldehyde, acetaldehyde, acetone, methyl ethyl ketone, methylamine, ethylamine, phenol, formic acid, acetic acid and propionic acid.

The above described carbon-containing gas can be introduced into the vacuum apparatus after the inside of the vacuum apparatus has been once decompressed to the pressure of $10^{-6}$ Pa. The partial pressure of the carbon-containing gas which can be employed at this time varies depending on the form of the electron-emitting device, the shape of the vacuum apparatus, the type of the carbon-containing gas to be employed and the like, and accordingly is appropriately set.

When a desired voltage is applied between the device electrodes 2 and 3, a strong electric field is generated in the gap 5, and the electron emission starts in the gap 5 through the electroconductive film 4. The emitted electron irradiates the opposing electroconductive film 4, and decomposes the carbon-containing gas which exists in the atmosphere and is adsorbed on the surface of the opposing electroconductive film 4 to make a film containing carbon (carbon film) deposited on the electroconductive film.

When the film containing carbon (carbon film) starts to be deposited, a stronger electric field is generated in the gap 5, and a larger number of electrons are emitted. Then, the carbon-containing film continually grows in a horizontal direction (direction perpendicular to energization direction) to expand a region of emitting electrons.

The above described film containing carbon (carbon film) can include graphitic carbon. The graphitic carbon according to the present invention includes the followings: a substance having a complete graphitic crystal structure (so-called HOPG); a substance having a crystal grain of approximately 20 nm and slightly disarrayed crystal structure (PG); a substance having a crystal grain of approximately 2 nm and a more disarrayed crystal structure (GC); and amorphous carbon (amorphous carbon and/or mixture of amorphous carbon and micro crystallites of the above described graphite).

That is to say, graphitic carbon even having a disarray of a layer such as in a crystal grain boundary between graphite particles can be used in the present invention.

On the other hand, as a result of an investigation made by the present inventors, silicon oxide can be involved in the above described activation treatment. It is found that when alumina containing no $SiO_2$, for instance, is used for a substrate, or when a substrate having a thin film of alumina coated on a glass substrate is used, the carbon-containing film is not deposited and does not grow even though the voltage is applied in the carbon-containing gas.

Accordingly, a material for the shielding portion 6 illustrated in FIGS. 1A, 1B, 1C and 1D or the substrate coat layer 7 illustrated in FIGS. 2A, 2B, 2C and 2D, in which the recess portion is processed, shall be a material which does not contain silicon oxide. Specifically, by using the material of aluminum oxide, silicon nitride, magnesium oxide, aluminum nitride or the like for the shielding portion or the substrate coat layer, the carbon film is inhibited from growing in a transverse direction in the above described activation treatment and the electron-emitting portion can also be formed only in a desired place.

This operation is more effective when the electroconductive film 4 is arranged in a subdivided form, because the carbon film can be inhibited from growing in the transverse direction by arranging the shielding portion 6 or the side face of the recess portion made from the above described different type of a material (material of hindering activation) adjacent to the electroconductive film 4. Then, the electron-emitting portion is automatically formed within a specified width of the subdivided electroconductive film 4, which facilitates the characteristics to be uniformized over a plurality of devices.

An ordinarily used means can be applied to a method of forming the shielding portion 6 illustrated in FIGS. 1A, 1B, 1C and 1D. For one example, there is a method of forming device electrodes 2 and 3 on a substrate 1, forming a film of oxide or nitride of the above described metal, and patterning the film with an etching technique.

In addition, in the form of FIGS. 2A, 2B, 2C and 2D, a recess portion is formed on a desired position on the substrate with an etching technique, and an electroconductive film 4 may be arranged in the recess portion so as to be connected to the device electrodes 2 and 3.

At this time, when a material which does not contain silicon oxide is provided on a glass substrate to be used for the insulating substrate 1 as a substrate coat layer 7, the substrate coat layer 7 is processed to such a depth as to make a layer containing silicon oxide, for instance, the glass substrate expose its surface at least at the bottom face of the recess portion. Alternatively, it is necessary to consider a method of arranging a member made from a material containing silicon oxide on the bottom face of the processed recess portion, or the like.

Next, an electroconductive film 4 which is arranged in a form of being divided into a plurality of the electroconductive films will now be described.

The feature of the present invention is that an electroconductive film 4 which constitutes one unit electron-emitting device is arranged in a form of being divided into the plurality of the electroconductive films, and a plurality of electron-emitting portions which has been formed in the above described activation step exist in one piece of the electroconductive film 4. These electron-emitting portions are driven by a constant voltage applied to device electrodes 2 and 3, but the electric current occasionally fluctuates due to the change of a vacuum degree and a vacuum atmosphere, and due to absorption and desorption of a gas molecule caused by the change, because the electron-emitting device uses a strong electric field.

Then, the electron-emitting device according to the present invention makes the electroconductive film 4 divided into the plurality of the electroconductive films to increase the ohmic value of each of the electroconductive films 4, and has a function of inhibiting the strong electric field generated in a gap from fluctuating when an electric current passing through one piece of the electroconductive film 4 has fluctuated, in other words, when the discharged electric current has increased or decreased.

The electron-emitting device has the divided electroconductive films 4, so that when the current increases in the electron-emitting portion corresponding to one piece of the electroconductive film 4, the voltage decreases due to the resistance of the electroconductive film 4 incident to the increase of the current, and the electric field in a gap 5 decreases in a direction of inhibiting the increase of the current. Thus, the electroconductive film can inhibit the increase of the current.

When the fluctuation of the electric current generated in one electron-emitting device occurs in one part of the electron-emitting portion of the device, the fluctuation of an effective voltage generated by the fluctuation of the electric current is defined by the resistance of one piece of the divided electroconductive film 4 which is directly connected to the electron-emitting portion that has caused the fluctuation of the current.

On the other hand, in the electroconductive film 4 which is not divided, the fluctuation of the effective voltage generated by the same fluctuation of the electric current is defined by the ohmic value of the whole electroconductive film 4, so that the fluctuation range of the voltage becomes small and the effect of inhibiting the fluctuation of the electric current also becomes small.

In this way, the above description means that when electroconductive films 4 which are made from the same material and have a constant film-thickness are used for the electron-emitting device and when the electroconductive films 4 have the same occupation area, an electroconductive film which is divided into the plurality of the electroconductive films and arranged as thin lines shows a larger effect of inhibiting the fluctuation of the electric current than an electroconductive film 4 which is arranged as a single piece.

Next, a method of forming an electroconductive film 4 which is divided into a plurality of the electroconductive films will now be described.

A plurality of electroconductive films 4 are formed so as to connect device electrodes 2 and 3 provided on an insulating substrate 1 to each other. As for a method of manufacturing the electroconductive film 4, a method can be adopted which forms an organic metal film by applying an organometallic solution and drying the solution, for instance, then heats and bakes the organic metal film, and patterns the organic metal film with a lift-off technique, an etching technique and the like.

A usable material for the electroconductive film 4 is an electroconductive material such as a metal and a semiconductor. The usable material includes, for instance: a metal such as Ni, Cr, Ag, Ru, Au, Mo, W, Pt, Ti, Al, Cu and Pd or an alloy thereof; a metal oxide such as PdO, $SnO_2$, $In_2O_3$, PbO and $RuO_2$; and a printed conductor constituted by the metal or the metal oxide, glass and the like.

A usable organometallic solution includes a solution of an organometallic compound that contains a metal such as Pd, Ni, Au and Pt, which is a material of the above described electroconductive film, as a main element. Here, the method of forming the electroconductive film 4 was described by taking a method of applying the organometallic solution as an example, but the method is not limited to the application method. The electroconductive film 4 can be also formed by using a vacuum vapor-deposition method, a sputtering method, a CVD method, a dispersion coating method, a dipping method, a spinner method, an ink-jet method or the like.

As a means of arranging the electroconductive film on a substrate in a divided form, a normal lithographic technology can be used, and a method can be appropriately selected from among a method of forming the electroconductive film as a continuous film with the above described methods and then dividing the film with an etching technique or the like, a method of forming the film by vapor deposition with the use of a mask, and the like.

The width of the divided electroconductive film 4 and the space between the electroconductive films 4 can be appropriately selected in a range of 50 nm to 50 μm according to the application.

When the electron-emitting device according to the present invention is applied to an electron source part of an SED (surface-conduction type electron emission display), an FED (field emission display) or the like, an image display apparatus having higher definition, uniformity and stability can be also realized.

Exemplary Embodiment

The present invention will now be described further in detail below with reference to exemplary embodiments.

Exemplary Embodiment 1

Figure 5A:
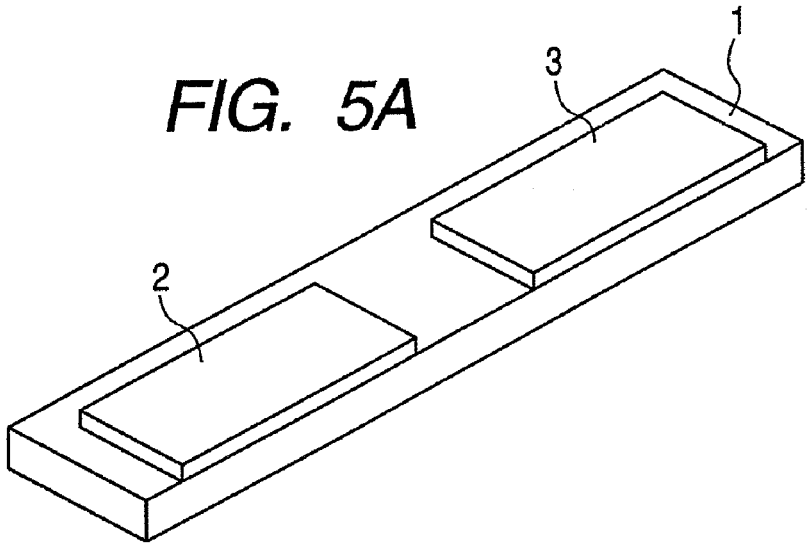
FIGS. 5A, 5B and 5C are perspective views illustrating a process of manufacturing the electron-emitting device in FIGS. 1A, 1B, 1C and 1D.
Figure 5B:
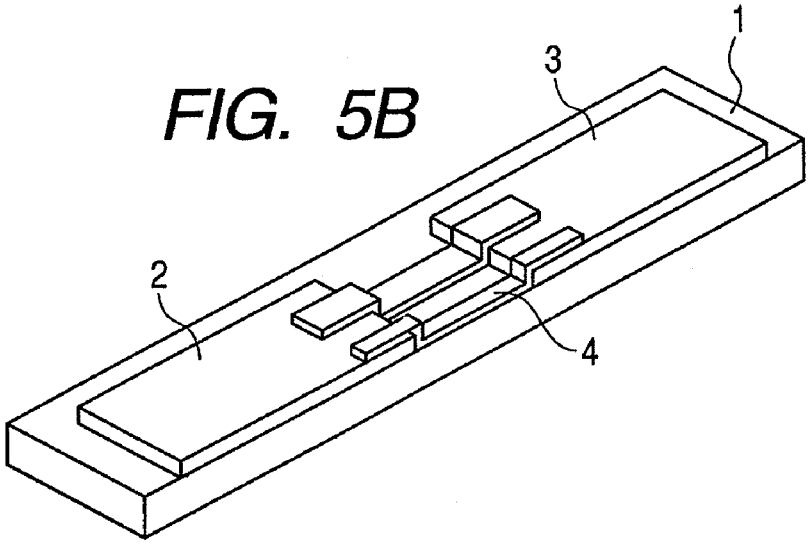
Figure 5C:
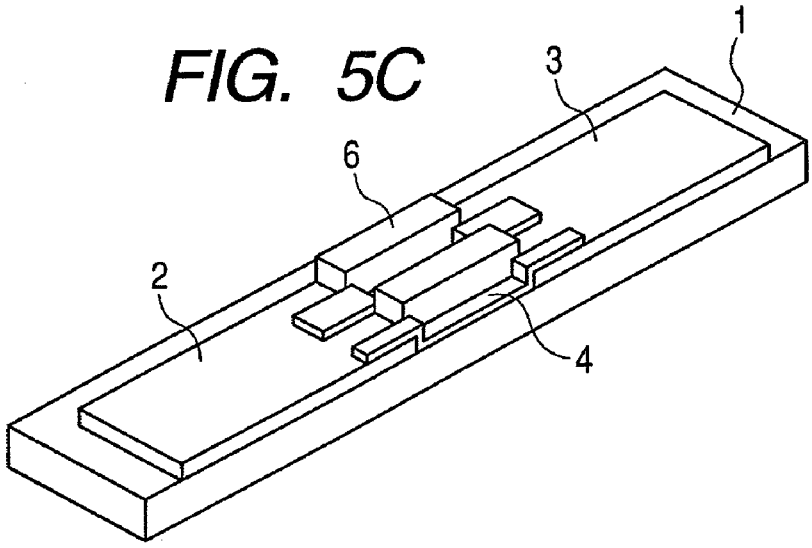

An electron-emitting device having a structure illustrated in FIGS. 1A, 1B, 1C and 1D was manufactured through the steps illustrated in FIGS. 5A, 5B and 5C. FIGS. 5A, 5B and 5C are perspective views corresponding to FIG. 1D.

<Step-a>

Firstly, a photoresist was formed on a cleaned insulating substrate 1 made from quartz so as to correspond to the pattern of device electrodes 2 and 3. Subsequently, Ti and Pt were sequentially deposited on the substrate so as to have thicknesses of 5 nm and 45 nm respectively, with an electron-beam vapor-deposition technique. The photoresist was dissolved with an organic solvent, the deposited Pt/Ti film was lifted off, and the electrode 2 and electrode 3 were formed so as to oppose to each other at a space (L) of 20 μm away. The width (W) of the electrodes 2 and 3 (see FIGS. 1A, 1B, 1C and 1D) was set at 500 μm [FIG. 5A].

<Step-b>

A solution of an organopalladium compound was rotatively applied by using a spinner so as to connect the electrode 2 with the electrode 3, and then the applied solution was heated and baked. Thus, a uniform film of an electroconductive film 4 containing Pd as a main element was formed.

<Step-c>

Subsequently, a mask pattern having a divided shape was formed on the electroconductive film, and a divided electroconductive film 4 was patterned with an Ar milling technique. The electroconductive film 4 was divided into 50 pieces at a space of 5 μm between the adjacent electroconductive films 4 so that each electroconductive film has a width (w) of 5 μm [FIG. 5B].

<Step-d>

Subsequently, the electrodes 2 and 3 were masked in as state of having left a mask pattern formed in <Step-c>, and an SiN film of 2 μm was vapor-deposited on the whole substrate. Then, the above described mask pattern was removed, and a shielding portion 6 having a height of 10 μm was formed on a substrate 1 which was adjacent to the divided electroconductive film 4 [FIG. 5C].

<Step-e>

Figure 6:
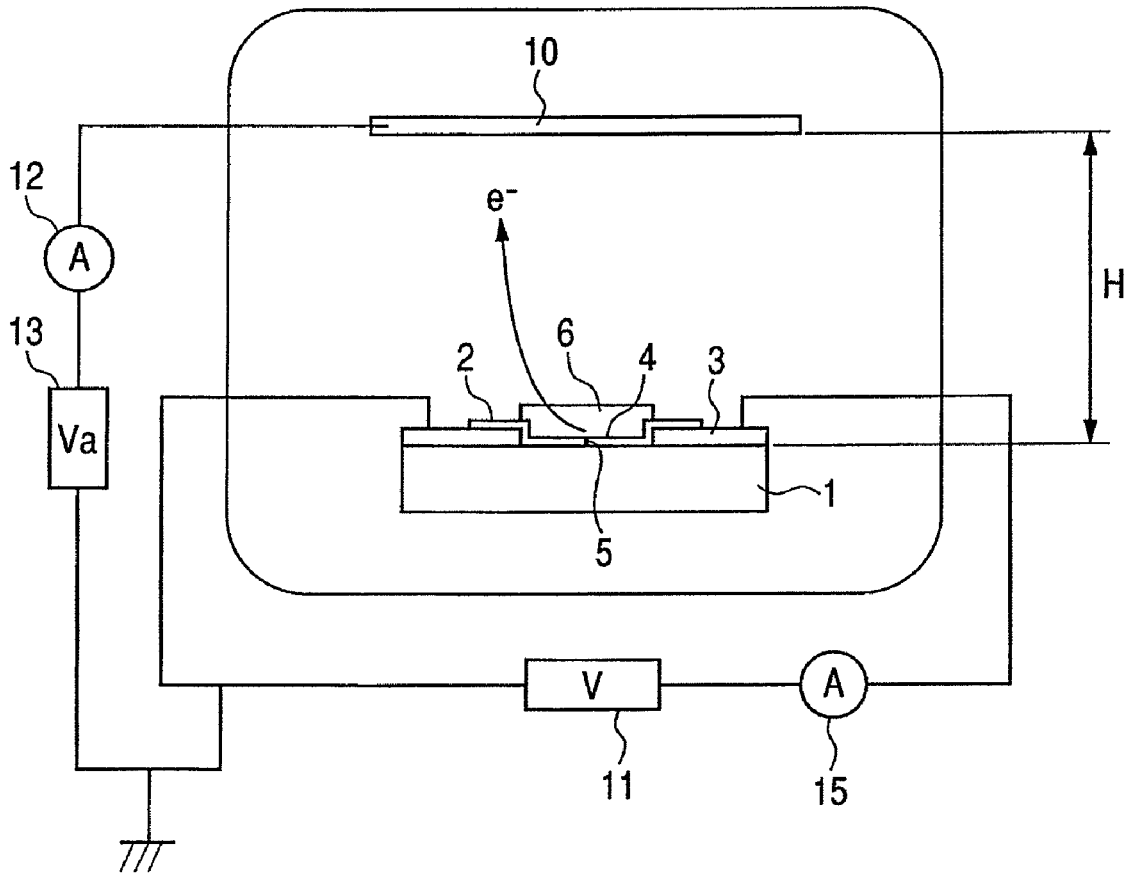
FIG. 6 is a schematic view of an apparatus for evaluating an electron-emitting device according to the present invention.

Subsequently, the above described substrate 1 was mounted on a measurement and evaluation device illustrated in FIG. 6, and the device was exhausted with a vacuum pump. After the vacuum degree reached $1\times10^{-6}$ Pa, a voltage Vf was applied between the electrodes 2 and 3 with the use of a power source 11 to conduct forming treatment and form a gap 5 in the electroconductive film 4. A voltage waveform as illustrated in FIG. 7 was used for the forming treatment.

Figure 7:
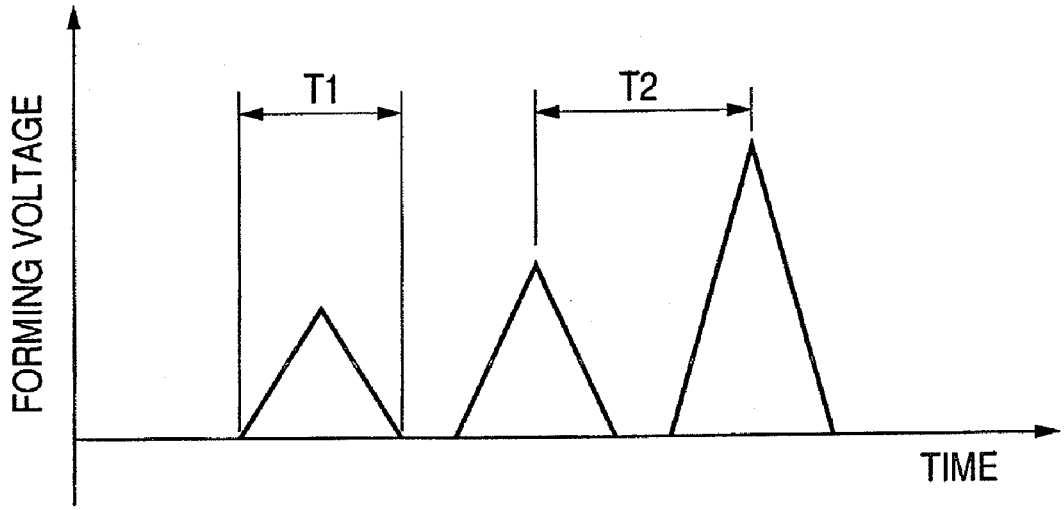
FIG. 7 is a schematic view illustrating one example of a pulse voltage to be applied in a forming step.

In FIG. 7, T1 and T2 show a pulse width and a pulse space in the voltage waveform. In the present example, T1 was set at 1 msec and T2 was set at 16.7 msec. The forming treatment was conducted by increasing the peak of the triangular wave stepwise by every 0.1 V. In the forming treatment, the resistance was measured by intermittently applying a resistance measurement pulse having a voltage of 0.1 V between the device electrodes 2 and 3. The forming treatment was finished when the value measured with the use of the resistance measurement pulse reached approximately 1 MΩ or more.

(Step-f)

Figure 8:
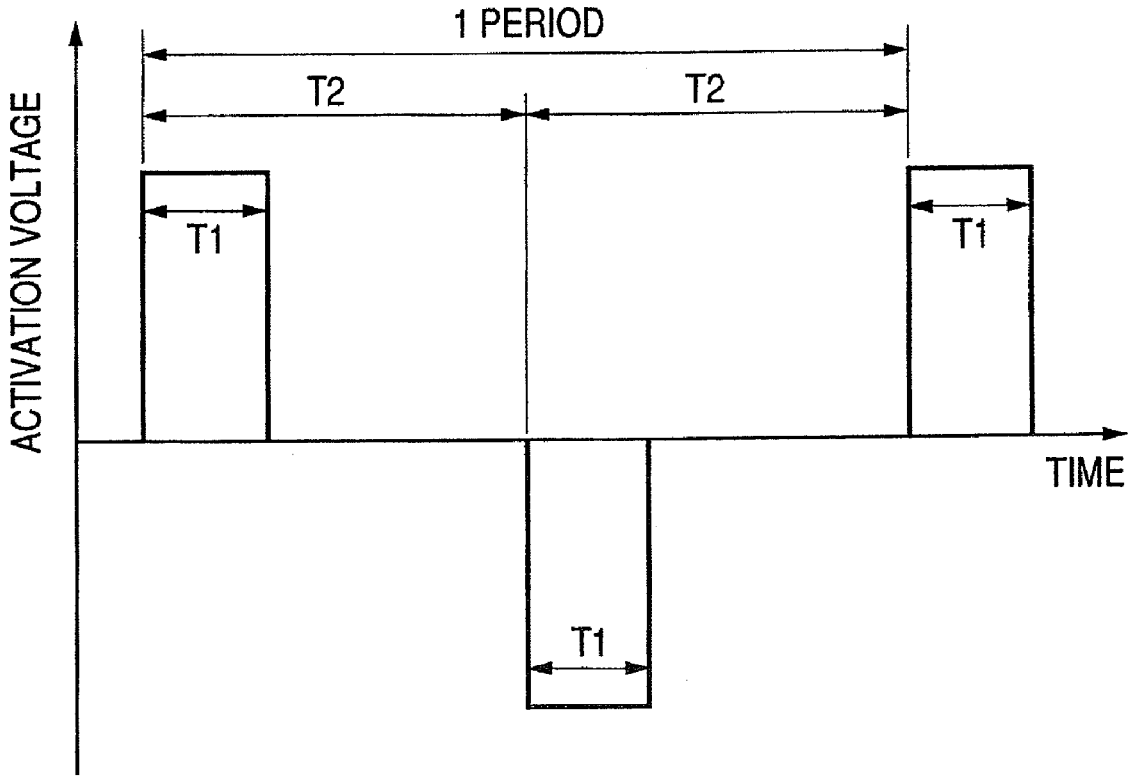
FIG. 8 is a schematic view illustrating one example of a pulse voltage to be applied in an activating step.

Subsequently, in order to conduct an activation step, benzonitrile was introduced into a vacuum apparatus through a slow leak bulb, and the vacuum apparatus was kept at $1.3\times10^{-4}$ Pa. Subsequently, the pulse voltage with the waveform illustrated in FIG. 8 was applied between the device electrodes 2 and 3 under conditions of T1 of 2 msec and T2 of 7 msec. In addition, in the "activation" treatment, the electrode 2 was always fixed to the ground potential, and the pulse voltage with the waveform illustrated in FIG. 8 was applied to the electrode 3. After 100 minutes had passed after the start of the activation treatment, it was confirmed that the device current was saturated. Then, the application of the voltage was stopped, the slow leak bulb was closed, and the "activation" treatment was finished.

A rectangular pulse voltage having the peak of 20 V, the pulse width of 1 millisecond and the frequency of 60 Hz was applied to the electron-emitting device which was obtained in this way, and the electron-emitting device was driven. In addition, a glass anode substrate 10 coated with a phosphor was arranged at a position of 2 mm above the surface of the device substrate, and a DC voltage of 10 kV was applied between the device and the anode substrate from the outside. The electrical characteristics of the electron-emitting device were measured and a light-emitting state on the phosphor was observed.

As a result, the light-emitting pattern on the phosphor in a position of 2 mm vertically above the device was substantially an ellipse, and the size in the longitudinal direction (length in direction perpendicular to energization direction) was approximately 700 μm. In addition, the current value which passed toward an anode substrate under the above described conditions was approximately 15 μA and was stable, and the fluctuation of a discharged electric current (standard deviation of current/average value of current) in 100 hours of continuous driving was 0.65%.

Comparative Example 1

In order to confirm an effect of a shielding portion 6 in an electron-emitting device shown in Exemplary embodiment 1, a device similar to that of Exemplary embodiment 1 except that a shielding portion 6 was not formed was produced, and the difference between the devices was confirmed. The device in the present example was manufactured through the same <Step-a> to <Step-c> and <Step-e> to <Step-f> as in Exemplary embodiment 1 while skipping only an SiN vapor-deposition step in <Step-d>, and had a device structure which did not have the shielding portion 6 therein.

As a result, the light-emitting pattern on the phosphor arranged in a position of 2 mm vertically above the device similarly to Exemplary embodiment 1 was a longer ellipse than that of Exemplary embodiment 1, and showed a shape which had an edge in a longitudinal direction extended and was slightly close to a crescent. In addition, the size in the longitudinal direction (length in direction perpendicular to energization direction) was expanded to approximately 820 μm. The value of the discharged electric current which was measured under the same condition as in Exemplary embodiment 1 was approximately 19 μA, and the fluctuation of a discharged electric current (standard deviation of current/average value of current) in 100 hours of continuous driving was 0.65%, which were the same values as in Exemplary embodiment 1.

From the above described comparison, it was confirmed that the shielding portion 6 inhibits the spread of the beam by cutting off a part of discharged electron beams.

Exemplary Embodiment 2

Figure 9A:
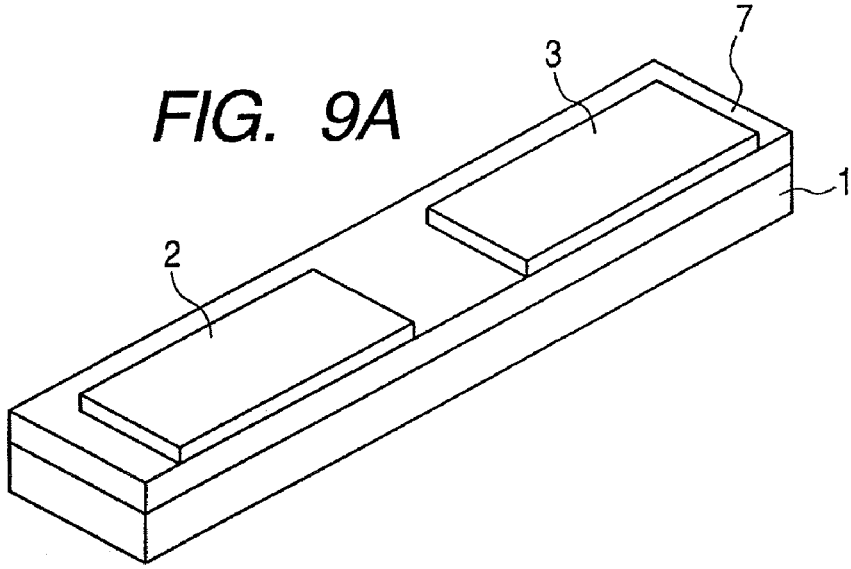
FIGS. 9A, 9B and 9C are perspective views illustrating a process of manufacturing the electron-emitting device in FIGS. 2A, 2B, 2C and 2D.
Figure 9B:
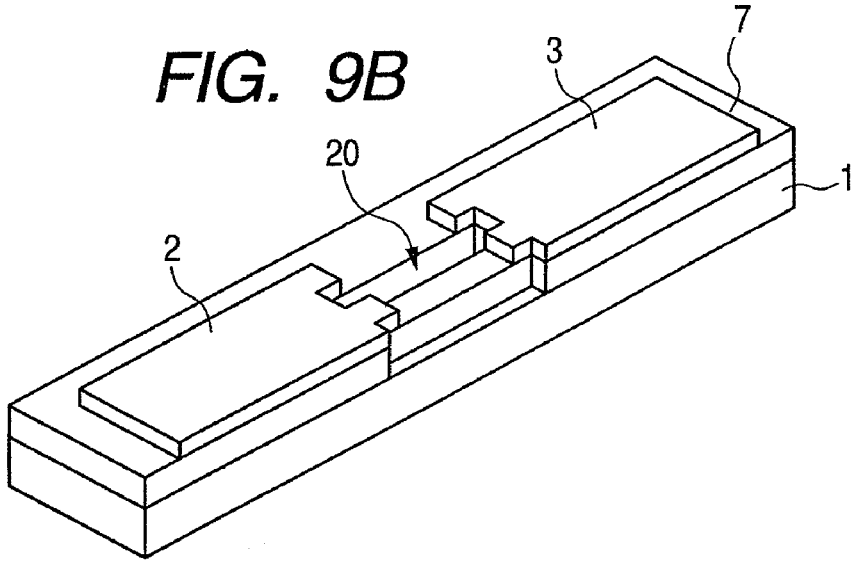
Figure 9C:
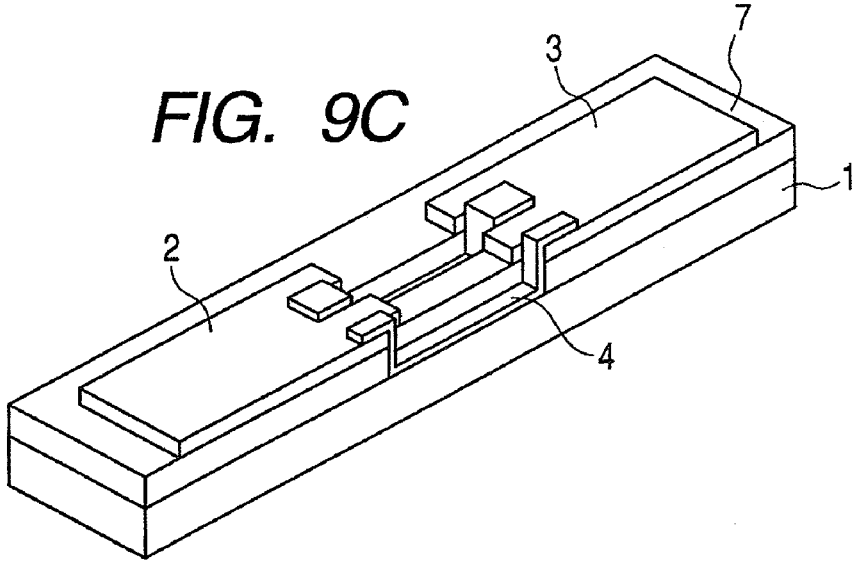

An electron-emitting device having a structure illustrated in FIGS. 2A, 2B, 2C and 2D was produced through the steps illustrated in FIGS. 9A, 9B and 9C. FIGS. 9A, 9B and 9C are perspective views corresponding to FIG. 2D.

<Step-a>

Firstly, a substrate coat layer 7 made from magnesium oxide (MgO) to be a member which would form a wall structure of a recess portion later was formed on the whole surface of a cleaned insulating substrate 1 made from quartz so as to have the thickness of 10 μm. Next, a photoresist was formed thereon so as to correspond to the pattern of device electrodes 2 and 3, and Ti and Pt were sequentially deposited thereon so as to have thicknesses of 5 nm and 45 nm respectively, with an electron-beam vapor-deposition technique. The photoresist was dissolved by an organic solvent, the deposited Pt/Ti film was lifted off, and the electrode 2 and electrode 3 were formed so as to oppose to each other at a space (L) of 20 μm away. The width (W) of the electrodes 2 and 3 (see FIGS. 2A, 2B, 2C and 2D) was set at 500 μm [FIG. 9A].

<Step-b>

Such a resist pattern was formed as to correspond to a recess portion 20 for forming an electroconductive film 4 therein astride the electrode 2 to the electrode 3, and then the substrate coat layer 7 was removed down to a depth at which the bottom face of the recess portion 20 reached the surface of the insulating substrate 1, with an etching technique. At this time, 50 positions of the recess portions 20 were formed, in which the width (w) of one recess portion 20 (=width of electroconductive film 4) was set at 5μm, and the space between the recess portions was set at 5μm [FIG. 9B].

<Step-c>

Subsequently, a mask pattern with such a divided shape as to correspond to the recess portion 20 which had been formed in <Step-b> was formed of a chromium thin film, then a solution of an organopalladium compound was rotatively applied by using a spinner, and the applied solution was heated and baked. Thus, a uniform film of the electroconductive film 4 containing Pd as a main element was formed. Afterward, the chromium thin film used as a mask pattern was removed with an etching technique, and the electroconductive film 4 was formed within the inner part of the recess portion 20 and on a part of the platinum electrode [FIG. 9C].

<Step-d>

Next, forming treatment was conducted, similarly to that of Step-e in Exemplary embodiment 1.

<Step-e>

Subsequently, activation treatment was conducted, similarly to that of Step-f in Exemplary embodiment 1.

A rectangular pulse voltage having the peak of 20 V, the pulse width of 1 millisecond and the frequency of 60 Hz was applied to the electron-emitting device which was obtained in the above steps, and the electron-emitting device was driven.

A glass anode substrate 10 coated with a phosphor was arranged at a position of 2 mm above the surface of the device substrate, and a DC voltage of 10 kV was applied between the device and the anode substrate from the outside. The electrical characteristics of the electron-emitting device were measured and a light-emitting state on the phosphor was observed.

As a result, the light-emitting pattern on the phosphor at the position of 2 mm vertically above the device was approximately an ellipse, similarly to the result in Exemplary embodiment 1, and the size in the longitudinal direction (length in direction perpendicular to energization direction) was approximately 700 μm. In addition, the current value which flowed into an anode substrate under the above described conditions was approximately 15 μA and was stable, and the fluctuation of a discharged electric current (standard deviation of current/average value of current) in 100 hours of continuous driving was 0.65%.

Exemplary Embodiment 3

An electron-emitting device having the structure illustrated in FIGS. 1A, 1B, 1C and 1D was produced similarly to that in Exemplary embodiment 1 except that the electroconductive film 4 was further subdivided.

A basic production method was similar to that in Exemplary embodiment 1, but the width (w) of the electroconductive film 4 and a space between adjacent electroconductive films 4 were set at 1 μm respectively, and the height of the shielding portion 6 was set at 2 μm. Accordingly, 250 pieces of the electroconductive films 4 were arranged in between the device electrodes 2 and 3 having W=500 μm.

As a result, a light-emitting pattern on the phosphor at a position of 2 mm vertically above the device showed a shape which was finer and closer to a circle than the devices produced in Exemplary embodiments 1 and 2, and the size of the light-emitting point was approximately 650 μm in a direction perpendicular to an energization direction, which means that the device in the present embodiment showed further enhanced convergence.

Exemplary Embodiment 4

Figure 10:
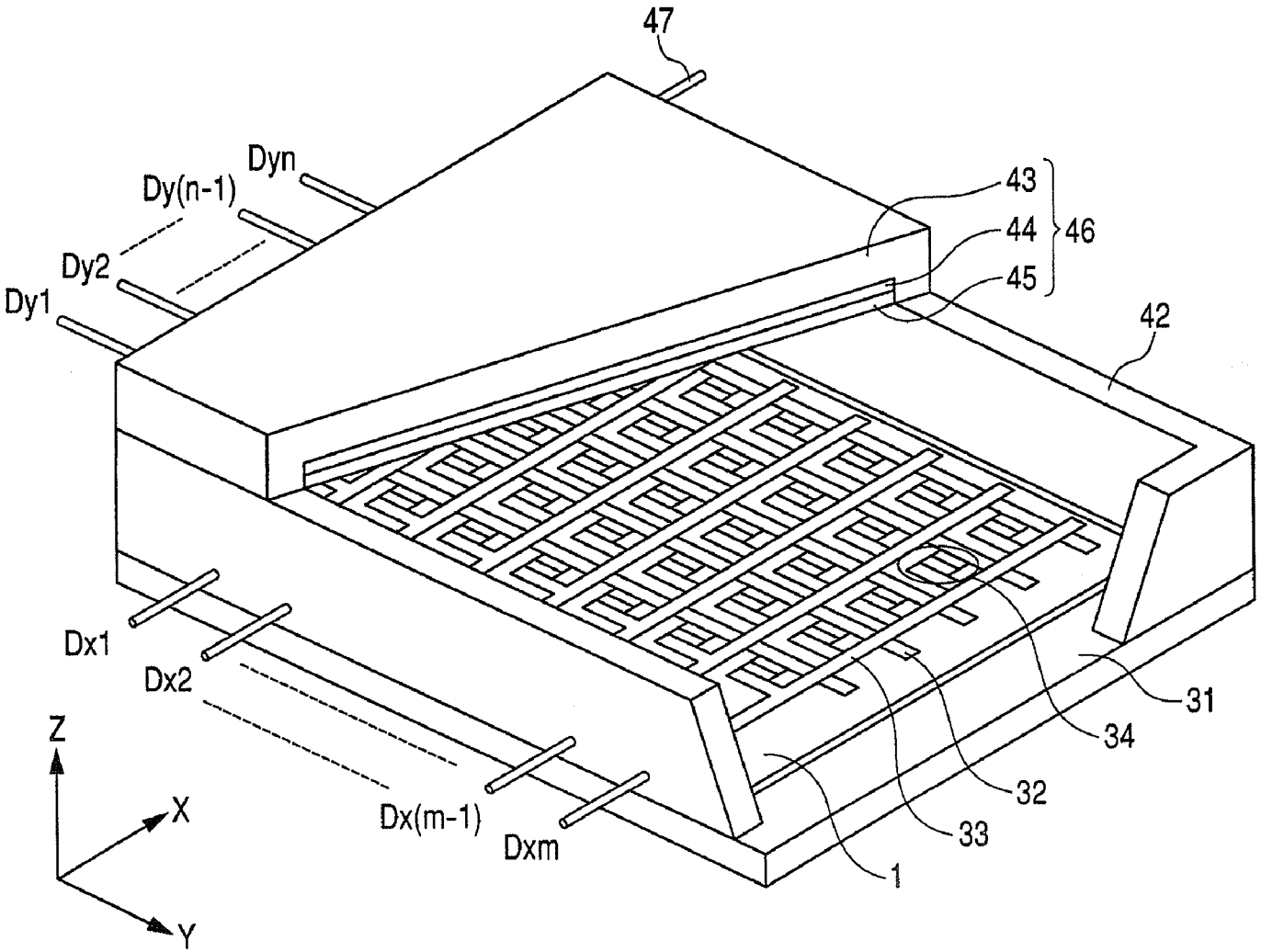
FIG. 10 is a schematic view of a display panel of one example of an image display apparatus according to the present invention.

In the present example, an electron source substrate was formed by preparing a plurality of electron-emitting devices with the same manufacturing method as that for the electron-emitting device which had been produced in the above described Exemplary embodiment 1, and arranging the devices in a matrix form on one and the same substrate. Furthermore, a second substrate provided with an image display member was arranged on this electron source substrate so as to oppose to each other, and an image display apparatus was produced. FIG. 10 is a perspective view of a display panel of the image display apparatus in the present example, in which one part of the display panel is cut away. In FIG. 10, a shielding portion 6 is omitted for convenience, and a device structure is also schematically illustrated. The process of manufacturing the electron source substrate is illustrated in FIG. 11A to FIG. 11E.

<Step of Producing Electrode>

Figure 11A:
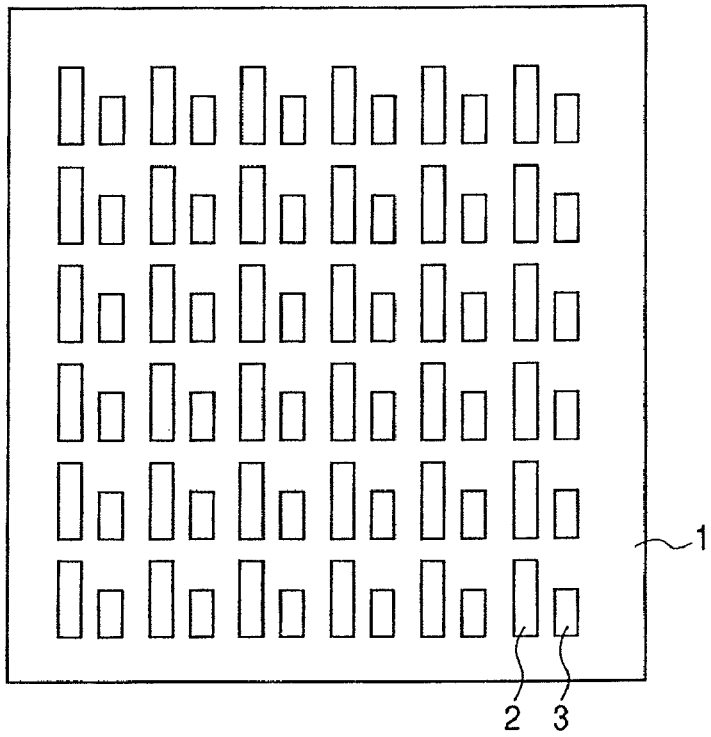
FIGS. 11A, 11B, 11C, 11D and 11E are schematic plan views illustrating a process of manufacturing an electron source according to an exemplary embodiment of the present invention.

An $SiO_2$ film was formed on a glass substrate 1. Furthermore, a large number of sets of device electrodes 2 and 3 were formed on the substrate 1 (FIG. 11A). Specifically, the device electrodes were formed by forming a stacked film of Ti and Pt with the thickness of 40 nm on the substrate 1, and patterning the film with a photolithographic technique. In the present example, the space (L) between the electrode 2 and the electrode 3 was set at 10 μm, and the width (w) was set at 100 μm.

<Step of Forming Wiring in Y-Direction>

Figure 11B:
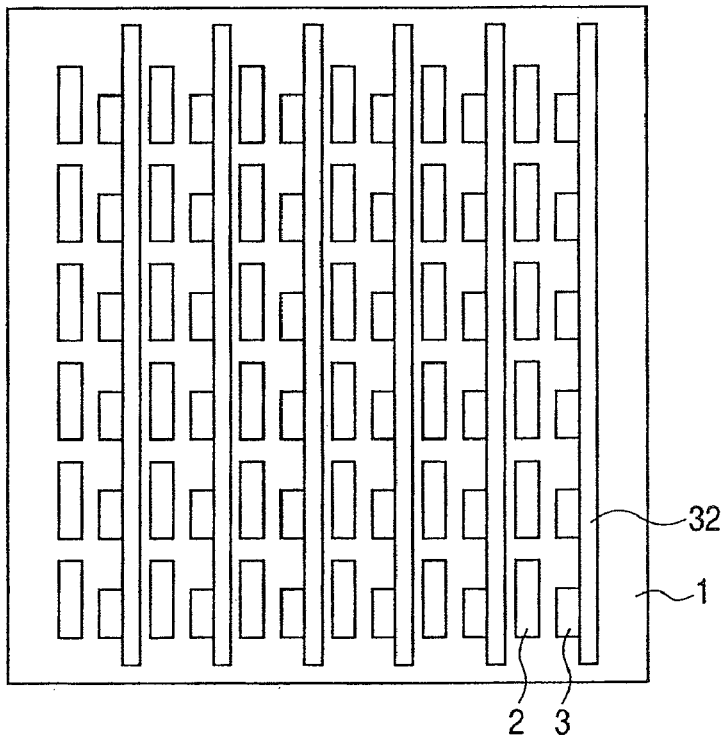

Next, wires of a Y-direction 32, which contained silver as a main component, were formed so as to be connected to the electrodes 3, as is illustrated in FIG. 11B. These wires of the Y-direction 32 function as wires to which a modulation signal is applied.

<Step of Forming Insulating Layer>

Figure 11C:
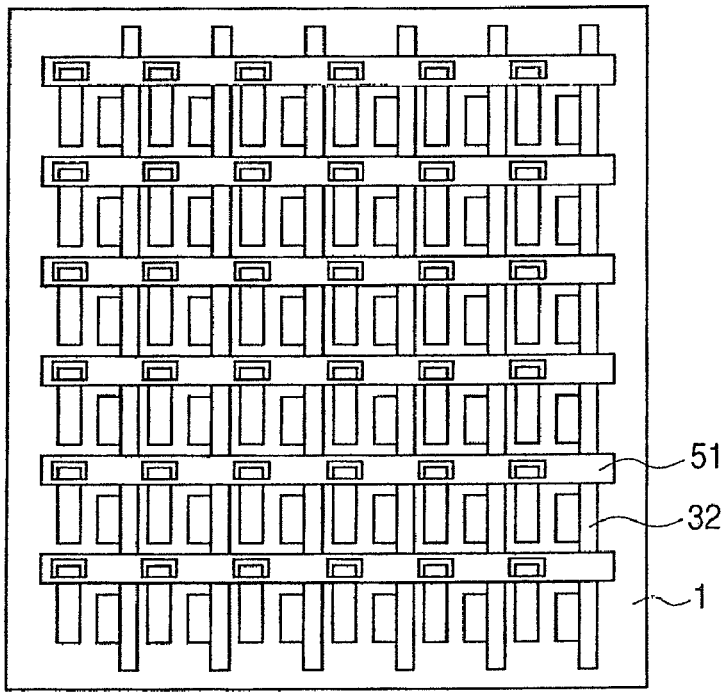

Next, in order to insulate the above described wires of the Y-direction 32 from wires of an X-direction 33, which would be formed in the next step, an insulating layer 51 made from silicon oxide was arranged as is illustrated in FIG. 11C. The insulating layer 51 was arranged under the wires of the X-direction 33, which would be described later, so as to cover the wires of the Y-direction 32 that had been formed previously. An opened contact hole was formed in one part of the insulating layer 51 so that the wires of the X-direction 33 could be electrically connected to the electrode 2.

<Step of Forming Wiring in X-Direction>

Figure 11D:
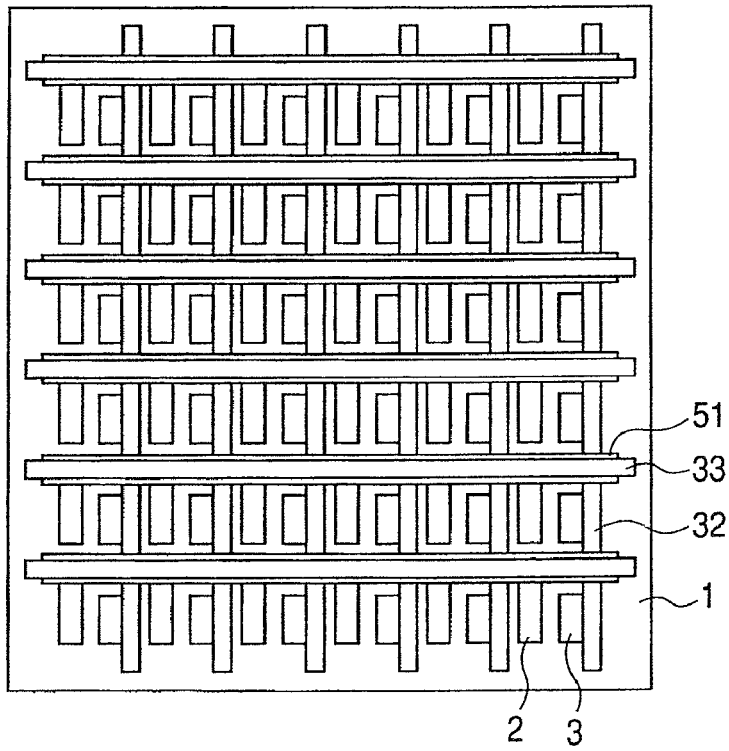

The wires of the X-direction 33, which contained silver as a main component, were formed on the insulating layer 51 that had been formed previously, as is illustrated in FIG. 11D. The wires of the X-direction 33 intersect with the wires of the Y-direction 32 while sandwiching the insulating layer 51 between themselves, and are connected to the electrode 2 in the portion of the contact hole of the insulating layer 51. These wires of the X-direction 33 function as wires to which a scan signal is applied. In this way, an electron source substrate having a matrix wiring thereon was formed.

<Step of Forming Electroconductive Film>

Figure 11E:
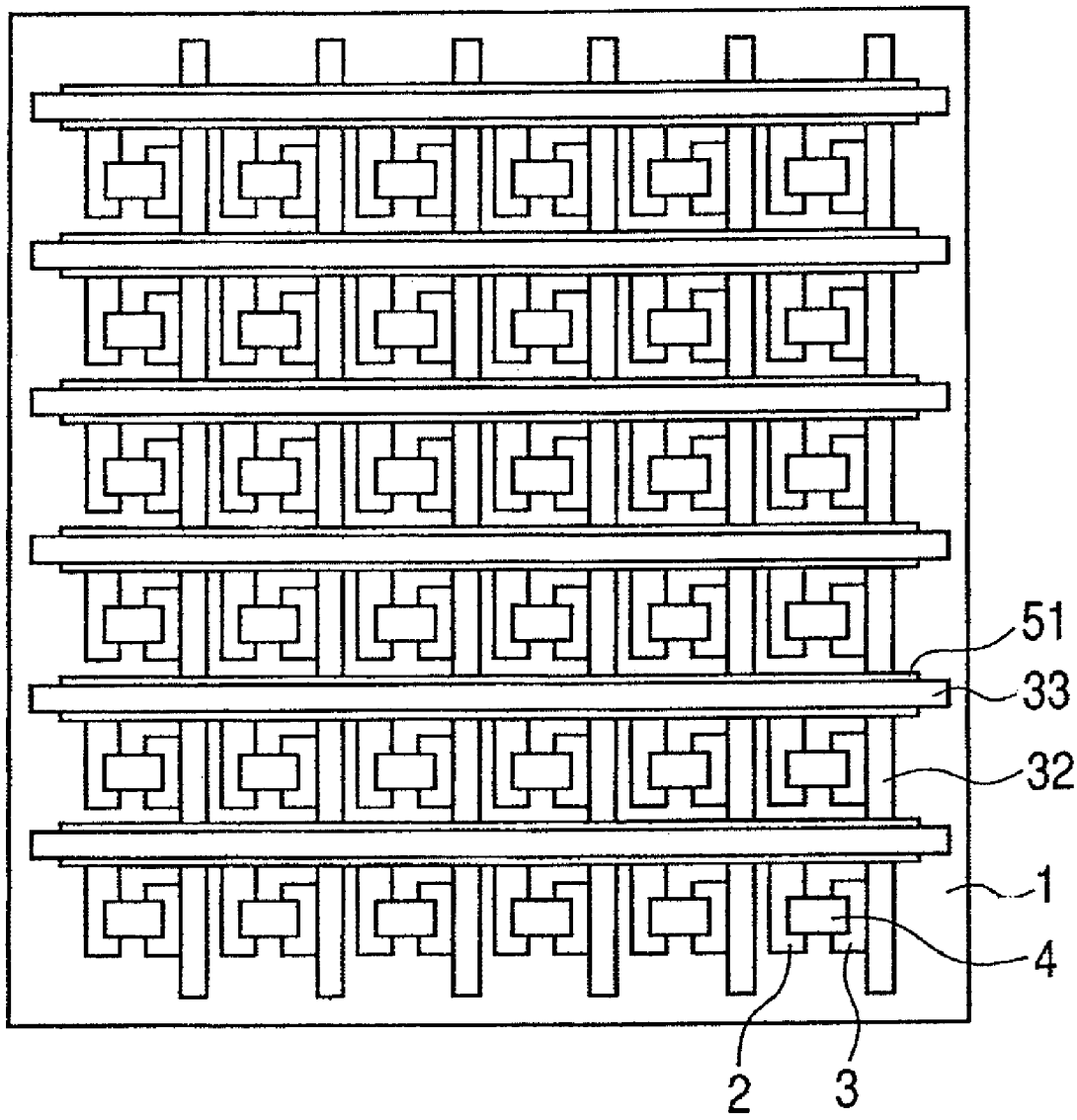

The electroconductive film 4 was formed in between the device electrodes 2 and 3 on the substrate 1 having the above described matrix wires formed thereon, with an ink-jet technique (FIG. 11E). In the present example, a solution of an organopalladium complex was used as an ink for use in the ink-jet technique. The solution of the organopalladium complex was applied to a space between the device electrodes 2 and 3, then the substrate 1 was heated and baked in the air, and the electroconductive film 4 made from palladium oxide (PdO)was formed.

<Step of Patterning Electroconductive Film>

The above described electroconductive film 4 was patterned into the form of being divided into a plurality of electroconductive films in a direction perpendicular to a direction in which the device electrodes 2 and 3 oppose each other, with a photolithographic technique, similarly to that in Exemplary embodiment 1. The width of the electroconductive film 4 and the space between adjacent electroconductive films 4 after having been patterned were set at 1 μm, respectively.

<Step of Forming Shielding Portion>

After the electroconductive film 4 had been patterned, a shielding portion 6 made from SiN was formed in a region adjacent to the electroconductive film 4, by the steps of vapor-depositing SiN and removing the mask pattern. The height of the shielding portion 6 was set at 2 μm which showed an adequate result in Exemplary embodiment 2.

<Forming Step and Activation Step>

Next, the substrate 1 was arranged in a vacuum container, which had a large number of units formed thereon, which were constituted by the device electrodes 2 and 3 and a plurality of the electroconductive films 4 for connecting the device electrodes 2 and 3 to each other through the above described steps. After the inside of the vacuum container had been exhausted, the substrate 1 was subjected to "forming" treatment and "activation treatment". The waveform of the voltage to be applied to each of the units and the like in the "forming" treatment and the "activation treatment" were the same as those shown in the method of producing the electron-emitting device in Exemplary embodiment 1.

The "forming" treatment was conducted with a method of applying just one pulse sequentially to every one line of the wires of the X-direction 33 selected from among a plurality of the wires of the X-direction 33. In other words, the step of "applying one pulse to one piece of the wires of the X-direction 33 selected from among the plurality of the wires of the X-direction 33, selecting another one line of the wires of the X-direction 33 and applying one pulse to the one line" was repeated.

The substrate 1 (first substrate, in other words, rear plate) in which a large number of the electron-emitting devices had been arranged could be produced by the above described steps.

Next, a face plate 46 (second substrate) in which a phosphor film 44 and a metal back 45 had been stacked on the inner face of a glass substrate 43 was arranged 2 mm above the above described substrate 1 through a supporting frame 42, as is illustrated in FIG. 10.

In the present example, the supporting frame 42 was attached to the substrate 1, but another new substrate 31 may be used as a reinforcement member in addition to the substrate 1, and the supporting frame 42 may be attached to the substrate 31, as is illustrated in FIG. 10. Then, the bonded portion of the face place 46, the supporting frame 42 and the substrate 1 was sealed by heating indium (In) which is a metal having a low melting point and by cooling the indium. This sealing step was carried out in a vacuum chamber, so that sealing and closing operations were simultaneously carried out without using an exhaust pipe.

In the present example, the phosphor film 44 which was an image display member to be irradiated with an electron emitted from the electron-emitting device was formed so as to have a stripe shape, in order to realize a color display. The phosphor film 44 was produced by previously forming black stripes (unshown) on the glass substrate 43, and applying phosphors (unshown) of each color to the gap portion with a slurry method. A material containing graphite as a main component, which is commonly used, was used as the material of the black stripe.

In addition, the metal back 45 made from aluminum was provided in the inner face side (electron-emitting device side) of the phosphor film 44. The metal back 45 was formed by vacuum-depositing Al on the inner face side of the phosphor film 44.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-126626, filed May 14, 2008, which is hereby incorporated by reference herein in its entirety.

What is claimed is:

1. An electron-emitting device comprising at least a pair of device electrodes formed on an insulating substrate, and a plurality of electroconductive films which are formed so as to connect the device electrodes to each other and have gaps therein, wherein the surface of a region which is adjacent to the gap between the electroconductive films and is not covered with the electroconductive film is higher than the surface of the electroconductive film.

2. The electron-emitting device according to claim 1, wherein a convex shielding portion is formed in the region which is adjacent to the gap between the electroconductive films and is not covered with the electroconductive film.

3. The electron-emitting device according to claim 2, wherein the shielding portion is made from an insulating material.

4. The electron-emitting device according to claim 3, wherein the insulating material is any one of aluminum oxide, silicon nitride, magnesium oxide and aluminum nitride.

5. The electron-emitting device according to claim 1, wherein the electroconductive films are arranged on the bottom face of a plurality of recess portions formed in between the device electrodes on the insulating substrate, respectively.

6. The electron-emitting device according to claim 5, wherein the bottom face of the recess portion is made from silicon oxide or an insulating material which contains silicon oxide as a main component.

7. The electron-emitting device according to claim 6, wherein a side face of the recess portion is made from any one of aluminum oxide, silicon nitride, magnesium oxide and aluminum nitride.

8. An image display apparatus comprising a first substrate having a plurality of the electron-emitting devices according to claim 1 arranged thereon, and a second substrate which has an image display member to be irradiated with an electron emitted from the electron-emitting device arranged thereon, and is arranged so as to oppose to the first substrate.

9. An electron-emitting device comprising an insulating substrate, a pair of electrodes arranged on the insulating substrate and a plurality of electroconductive films which are placed in between the pair of the electrodes in parallel so as to connect the electrodes to each other, wherein each of the plurality of the electroconductive films has an electron-emitting portion, and an insulating member which is positioned higher than the surface of the electroconductive film is arranged in a region on the insulating substrate between the electroconductive films adjacent to each other among the plurality of the electroconductive films.

10. An image display apparatus comprising a first substrate having a plurality of the electron-emitting devices according to claim 9 arranged thereon, and a second substrate which has an image display member to be irradiated with an electron emitted from the electron-emitting device arranged so as to oppose to the electron-emitting devices, and is arranged so as to oppose to the first substrate.

11. An electron-emitting device comprising an insulating substrate, a pair of electrodes arranged on the insulating substrate and a plurality of electroconductive films which are placed in between the pair of the electrodes in parallel so as to connect the electrodes to each other, wherein each of the plurality of the electroconductive films has an electron-emitting portion, and the surface of the insulating substrate in between the electroconductive films adjacent to each other among the plurality of the electroconductive films is positioned higher than the surface of the electroconductive film.

12. An image display apparatus comprising a first substrate having a plurality of the electron-emitting devices according to claim 11 arranged thereon, and a second substrate which has an image display member to be irradiated with an electron emitted from the electron-emitting device arranged thereon, and is arranged so as to oppose to the first substrate.

* * * * *